United States Patent [19]

Kaneshiro

[11] 4,365,720

[45] Dec. 28, 1982

[54] TOOL HOLDER

[76] Inventor: Edward S. Kaneshiro, 452 Harbor Ter., Bartlett, Ill. 60103

[21] Appl. No.: 181,058

[22] Filed: Aug. 25, 1980

[51] Int. Cl.[3] ..... A47F 5/08

[52] U.S. Cl. ..... 211/60 T; 211/73; 211/87

[58] Field of Search ..... 211/607, 40, 73, 87, 211/72, 75; 248/174

[56] References Cited

U.S. PATENT DOCUMENTS

| | | | |
|---|---|---|---|
| 1,684,124 | 9/1928 | Burgess | 211/73 X |
| 1,718,319 | 6/1929 | Towell | 211/73 X |
| 2,841,289 | 7/1958 | Odlum et al. | 211/87 |
| 3,179,255 | 4/1965 | De'Caccia | 211/60 T |
| 3,739,917 | 6/1973 | Okutani | 211/40 |

*Primary Examiner*—William E. Lyddane
*Assistant Examiner*—Robert W. Gibson, Jr.

[57] ABSTRACT

A tool holder which, in accordance with one embodiment, simply is an integral length of sheet material such as sheet metal or plastic which is folded to form a triangle having a back wall, a bottom wall and a top wall. The top wall slopes outwardly and downwardly from the upper edge of the back wall, preferably at an angle of approximately 45°, and has a cut-out in it which is shaped and proportioned to receive a particular type of power tool, such as a skill saw or drill. The back wall has means, such as a keyhole slot, for removably securing the tool holder to a support surface, such as a wall. The lower edge of the back wall also can be folded to extend outwardly perpendicular to the back wall and beneath the bottom wall so as to form a flange or shelf which supports the end edge of the bottom wall and thus adds rigidity to the tool holder. The tool holder is simply secured to a support surface by means of threaded screws, nails or the like, and the power tool then is disposed within the cut-off in the sloped top wall for storage.

In accordance with another embodiment, the tool holder is of a knock-down construction, with the tool holder being of a three-piece construction.

3 Claims, 4 Drawing Figures

TOOL HOLDER

BACKGROUND OF THE INVENTION

This invention relates to a tool holder for storing and displaying tools, particularly power tools such as sabre saws, skill saws, drills and the like.

Most craftsman and do-it-yourself homeowners have various power tools such as sabre saws, skill saws, drills and the like and, normally, these power tools are simply stored on shelves. In many instances, it would be convenient to have relatively inexpensive tool holders for these power tools so that they not only could be stored in an orderly fashion but in a fashion to also protect them from damage or abuse.

The tool holder of the present invention satisfies these needs and, furthermore, is of a design and construction such that a manufacturer can effectively package the power tool in them for storage and shipment. Further still, a retailer can effectively utilize the tool holder as a display for displaying the tool. The cost can be such that the manufacturer or retailer can absorb the cost of the tool holder in the purchase price, thus adding a bonus to the purchase of the power tool. Alternatively, the tool holder can be merchandised as a separate item.

The above objectives are accomplished with the tool holder of the present invention which, in accordance with one embodiment, simply is an integral length of sheet material such as sheet metal or plastic which is folded to form a triangle having a back wall, a bottom wall and a top wall. The top wall slopes outwardly and downwardly from the upper edge of the back wall, preferably at an angle of approximately 45°, and has a cut-out in it which is shaped and proportioned to receive a particular type of power tool, such as a skill saw or drill. The back wall has means, such as a keyhole slot, for removably securing the tool holder to a support surface, such as a wall. The lower edge of the back wall also can be folded to extend outwardly perpendicular to the back wall and beneath the bottom wall so as to form a flange or shelf which supports the end edge of the bottom wall and thus adds rigidity to the tool holder. The tool holder is simply secured to a support surface by means of threaded screws, nails or the like, and the power tool then is disposed within the cutoff in the sloped top wall for storage.

In accordance with another embodiment, the tool holder is of a knock-down construction, with the tool holder being of a three-piece construction.

A manufacturer of the power tool can secure the power tool in place in the cut-out in the top wall for storage and shipment. If desired, a heat shrink plastic cover can be utilized. A retailer can display the power tool conveniently and attractively, with it still disposed within the tool holder.

OBJECTS OF THE INVENTION

Accordingly, it is an object of the invention to provide an improved tool holder for storing and displaying tools, particularly power tools.

These and other objects will be apparent from the following description and drawings wherein:

DETAILED DESCRIPTION OF THE PREFERRED EMBODIMENT

Figure 1:
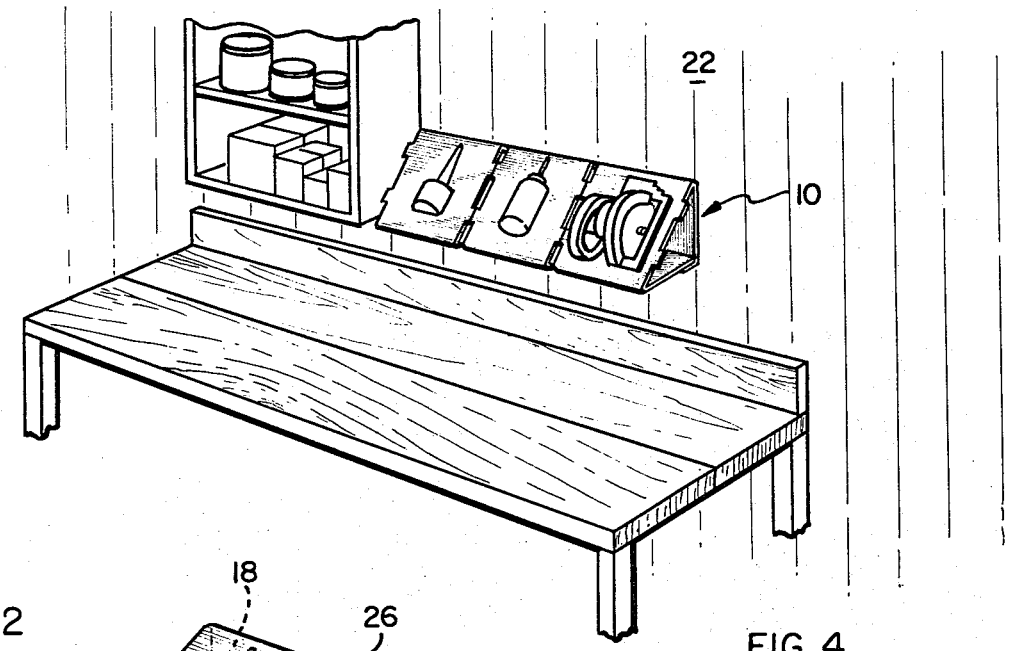
FIG. 1 is a perspective view generally illustrating the manner in which the tool holder can be utilized in a work shop.

Referring now to the drawing, the tool holder 10 includes a back wall 12, a bottom wall 14 and a top wall 16. The back wall 12 is vertically disposed and has fastening means such as a pair of keyhole slots 18 and 20 for removably securing the tool holder 10 to a vertical support surface such as a wall 22. Other appropriate fastening means likewise can be used to secure the tool holder 10 to a support surface.

The bottom wall 14 extends perpendicularly outwardly with respect to the back wall 12, and effectively supports the top wall 16, as more fully described below.

Figure 2:
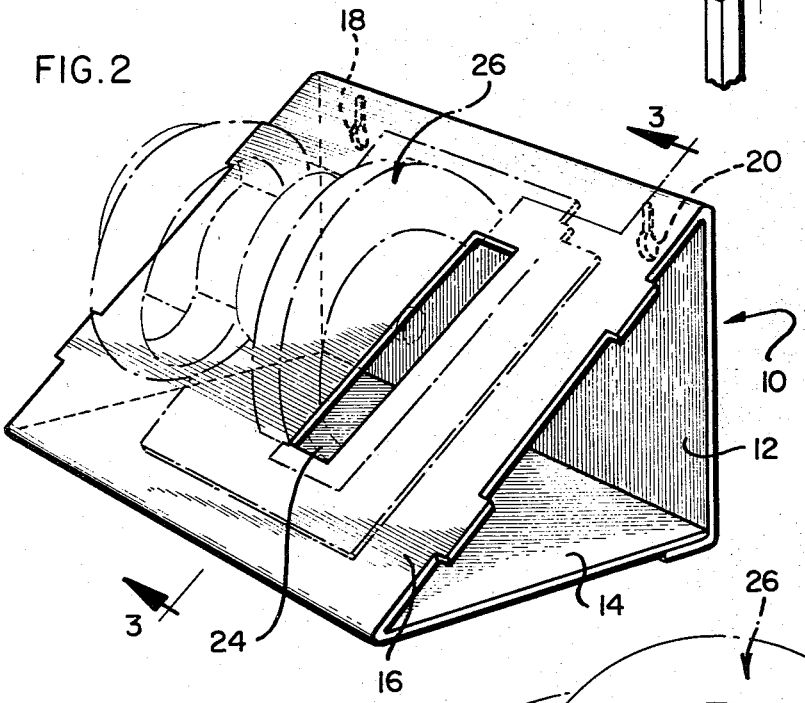
FIG. 2 is a perspective view of a tool holder exemplary of one embodiment of the invention.
Figure 3:
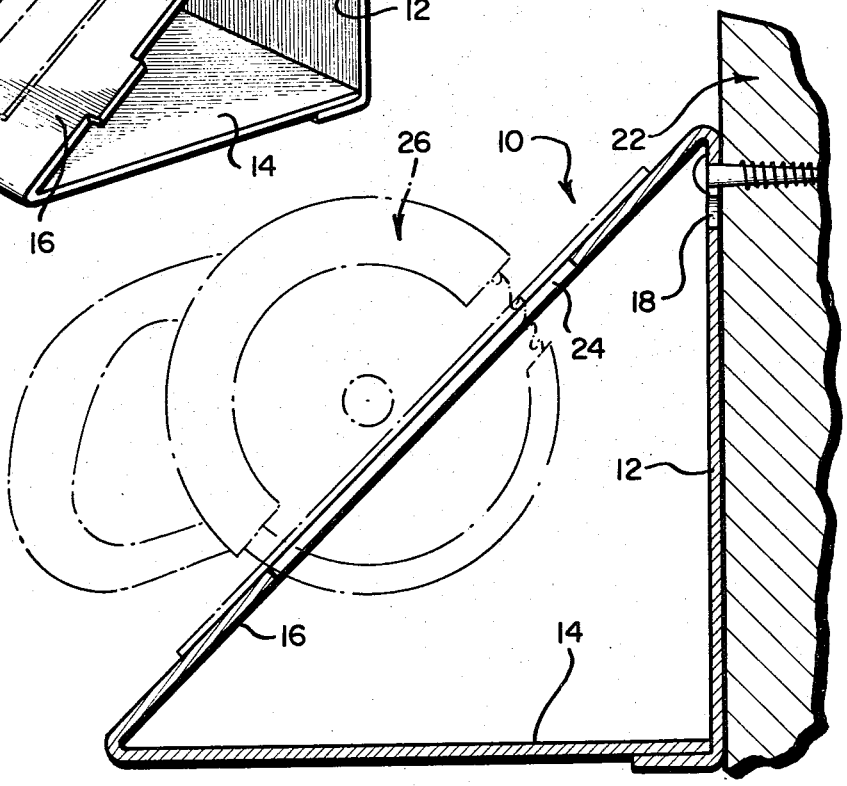
FIG. 3 is a sectional view taken generally along lines 3—3 of FIG. 2.

The top wall 16 extends downwardly and outwardly at an angle with respect to the back wall 12 so as to provide a sloped surface, and has a cut-out 24 formed in it which is sloped and proportioned to receive therein a power tool which may be, for example, a skill saw 26, as illustrated in FIGS. 2 and 3. It is anticipated that tool holders 10 having cut-outs 24 for a whole host of different types of power tools will be provided.

It is preferred to have the top wall 16 at an angle to form a sloped surface since the power tool is more easily supported by the tool holder 10. The power tool will simply seat in the cut-out 24 in the top wall 16, and is effectively retained therein by its own weight. Also, being sloped, the power tool is more readily observed. The latter feature provides greater utility, particularly when the tool holder 10 is used by a retailer to display the power tool for sale.

Since the top wall 16 is sloped, the weight of the power tool may tend to bend it. However, this is prevented by the bottom wall 14 which supports or retains the lower edge of the top wall 16 a fixed or spaced distance out from the back wall 12.

The tool holder 10 may be formed as an integral unit from a length of sheet material, such as sheet metal or plastic, which is simply folded or formed triangular shaped, as illustrated in FIGS. 2 and 3. In such a case, the cut-out 24 and the keyhole slots 18 and 20 are formed therein before the length of sheet material is folded. Also, the back wall 12 can be folded at its lower edge to extend perpendicularly outwardly and beneath the bottom wall 14, to provide additional support for the bottom wall 14 and additional rigidity to the tool holder 10.

Figure 4:
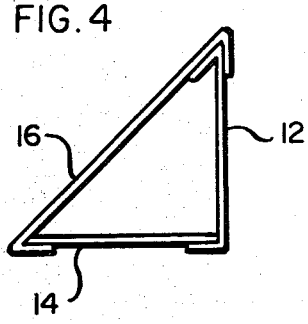
FIG. 4 is a sectional view illustrating a tool holder formed in accordance with another embodiment of the invention.

Alternatively, the tool holder 10 can be formed to provide a knock-down assembly which can be easily and quickly assembled for use, as illustrated in FIG. 4. In this case, the back wall 12, the bottom wall 14 and the top wall 16 are separately cut and formed. For example, the top wall 16 can be cut to provide the cut-out 24 in it and then folded at each of its ends at 45° angles, as illustrated. The back wall 12 has one end formed at a 45° angle and its other end at a 90° angle. The bottom wall 14 can be simply a flat sheet of material. The walls can be assembled and secured together in any suitable fashion, if desired, by means of threaded screws, interlocking slots or the like, prior to being secured to a support surface. Alternately, the top and back walls 16 and 12 can be provided with keyhole slots which not only function to secure the tool holder 10 to a support surface but to secure the top and back walls together in an assembled fashion. Thereafter, the bottom wall 14 is simply placed in position, and secured, if desired.

Now that the invention has been described, what is claimed as new and desired to be secured by Letters Patent is:

1. A tool holder for storing and displaying tools, said tool holder being of a three-piece construction formed from sheet material which is folded and assembled to form a generally right angle triangle, said tool holder having a back wall which has an upper end portion which is folded at a generally 45 degree angle and a lower end portion which is folded at a generally 90 degree angle, said back wall including means for removably affixing said tool holder to a support surface, a top wall which has end portions which are folded at a generally 45 degree angle, and a bottom wall, one of said end portions of said top wall being overlapped with the upper end portion of the back wall and said bottom wall being seated on the lower end portion of the back wall and the other one of said end portions of said top wall to thereby support said top wall to provide a sloped surface, said top wall having a cut-out therein proportioned to receive and support therein a tool.

2. The tool holder of claim 1, wherein said means for removably affixing said tool holder to a support surface comprises a plurality of keyhole slots formed in said back wall for receiving therein the head portion of a threaded screw or the like.

3. The tool holder of claim 1, being of a three-piece knocked-down construction.

* * * * *